US007290376B2

(12) United States Patent
Emiliani

(10) Patent No.: US 7,290,376 B2
(45) Date of Patent: Nov. 6, 2007

(54) WALL DEVICE FOR FITTINGS

(75) Inventor: Fausto Emiliani, Imola (IT)

(73) Assignee: DE Agency S.R.L., Calderara di Reno (Bologna) (IT)

( * ) Notice: Subject to any disclaimer, the term of this patent is extended or adjusted under 35 U.S.C. 154(b) by 425 days.

(21) Appl. No.: 10/505,395

(22) PCT Filed: Dec. 30, 2002

(86) PCT No.: PCT/IB02/05667

§ 371 (c)(1),
(2), (4) Date: Aug. 20, 2004

(87) PCT Pub. No.: WO03/071077

PCT Pub. Date: Aug. 28, 2003

(65) Prior Publication Data

US 2005/0166497 A1 Aug. 4, 2005

(30) Foreign Application Priority Data

Feb. 21, 2002 (IT) ..... BO2002A0087

(51) Int. Cl.

| | |
|---|---|
| ***E04C 2/52*** | (2006.01) |
| ***E04D 13/14*** | (2006.01) |
| ***E04G 15/06*** | (2006.01) |
| ***E04H 12/28*** | (2006.01) |
| ***H01H 9/02*** | (2006.01) |
| ***H01H 13/04*** | (2006.01) |
| ***H01H 19/04*** | (2006.01) |
| ***H01H 21/04*** | (2006.01) |
| ***H01H 23/04*** | (2006.01) |
| ***H01R 13/46*** | (2006.01) |
| ***B65D 6/28*** | (2006.01) |
| ***B65D 8/18*** | (2006.01) |
| ***H02G 3/08*** | (2006.01) |
| ***F16L 5/00*** | (2006.01) |

(52) U.S. Cl. ..... 52/220.8; 52/219; 174/58; 220/4.02; 220/3.6; 137/360

(58) Field of Classification Search ..... 52/220.1, 52/220.7, 220.8, 219; 174/58; 220/4.02, 220/3.2–3.6; 137/360
See application file for complete search history.

(56) References Cited

U.S. PATENT DOCUMENTS

| | | | | |
|---|---|---|---|---|
| 2,187,490 | A | 1/1940 | Dewey et al. | |
| 3,529,388 | A * | 9/1970 | Wullschleger | 52/220.8 |
| 5,426,904 | A | 6/1995 | Gilmore | |
| 6,061,910 | A * | 5/2000 | Williamson | 29/897.312 |
| 6,101,773 | A | 8/2000 | Chau et al. | |
| 6,330,773 | B1 * | 12/2001 | MacDonald et al. | 52/239 |
| 7,021,013 | B1 * | 4/2006 | Schilling et al. | 52/219 |
| 7,204,267 | B1 * | 4/2007 | Persico | 137/360 |

FOREIGN PATENT DOCUMENTS

EP 0 243 642 B 11/1987

* cited by examiner

*Primary Examiner*—Richard E. Chilcot, Jr.
*Assistant Examiner*—Hunter M Dreidame
(74) *Attorney, Agent, or Firm*—William J. Sapone; Coleman Sudoi Sapone P.C.

(57) ABSTRACT

A wall device for supporting fittings includes a plurality of horizontal and vertical uprights (2), which can be assembled together to form the wall device. The horizontal and vertical uprights are mutually coupled together by at least one first adjustable fixing device (10), with connection elements (20) used for joining the fittings. The uprights (2) include at least a first channel section (5) and a second channel section (6), each including, starting from a respective bottom side (50), two respective opposed side parts (51) nearly orthogonal to the bottom side (50), and two respective first portions (52), parallel to the bottom side (50). The sides, parts and portions (50, 51, 52) of at least the first channel section (5) and the second channel section (6) define a respective cavity (55) and longitudinal openings (8) for the first fixing device (10) and for the connection elements (20). At least a first portion (52) of each first channel section (5) has also a second portion (53) orthogonal to the first portions (52) and facing outwards from the respective cavity (55).

38 Claims, 13 Drawing Sheets

FIG.5
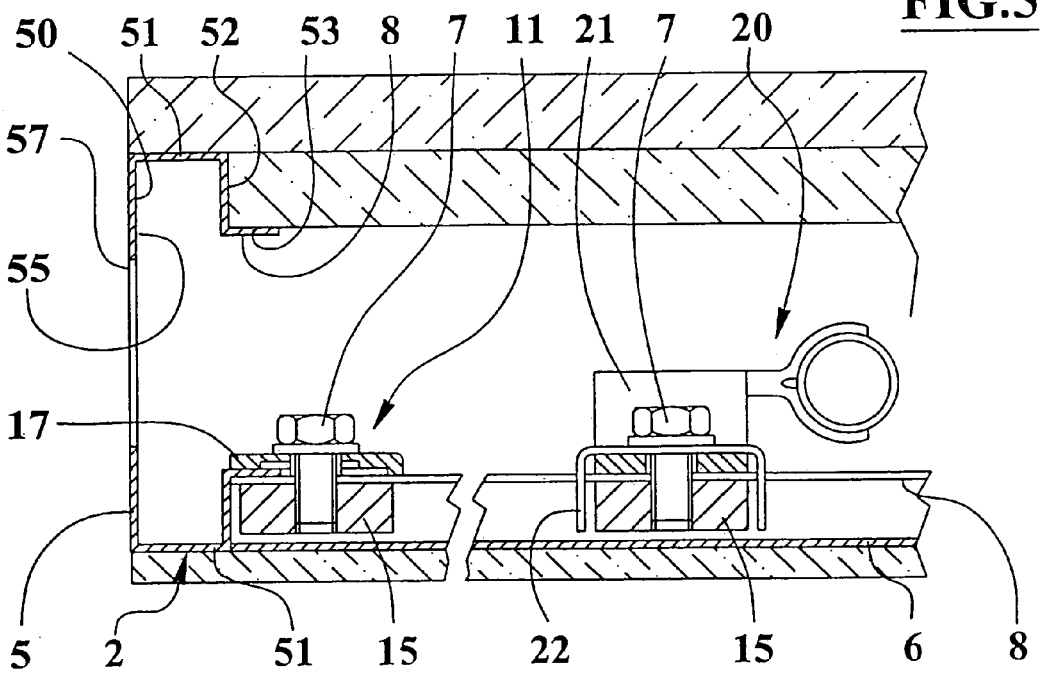
FIG.6
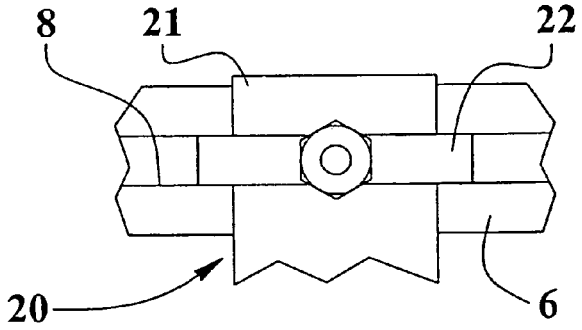
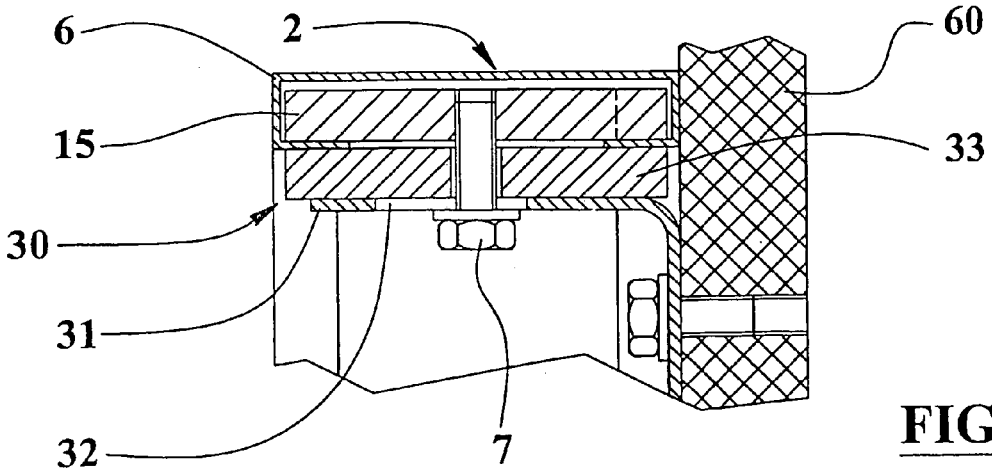
FIG.7

FIG.8
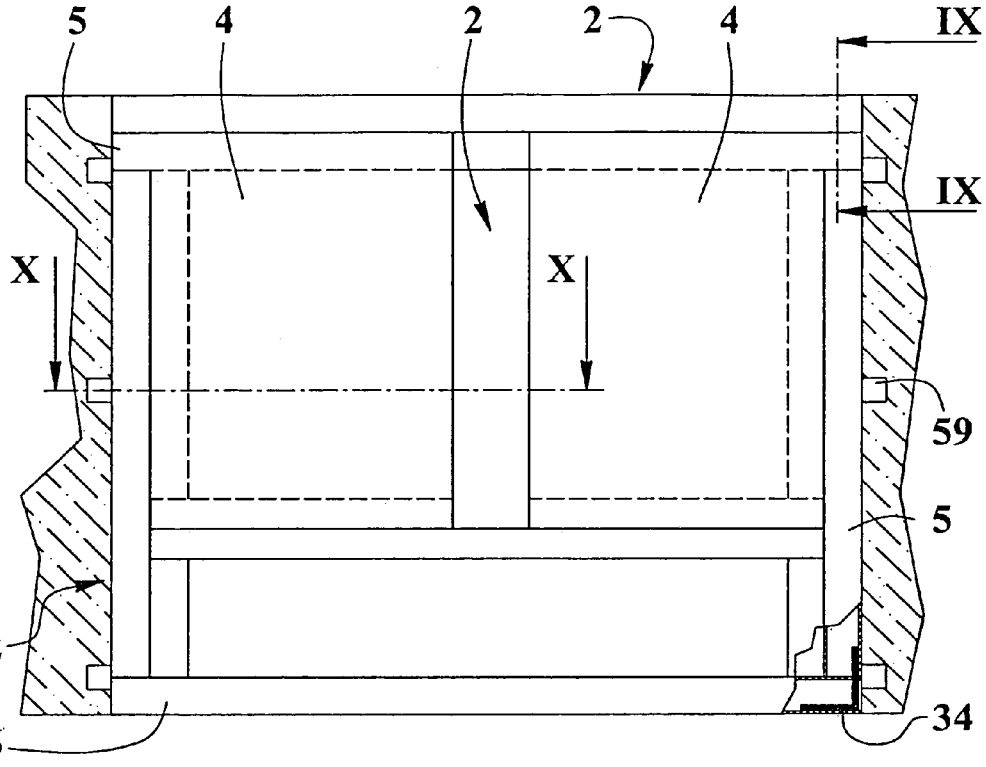
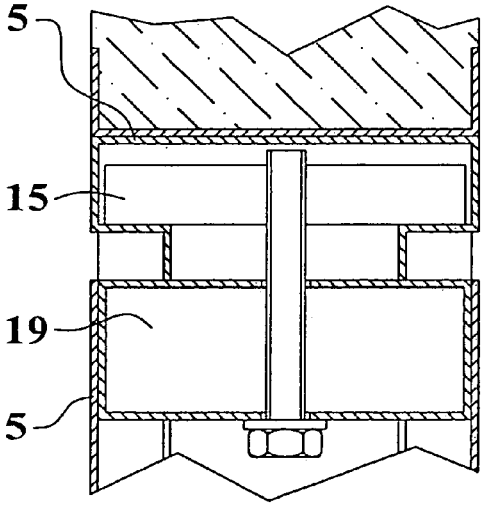
FIG.9A
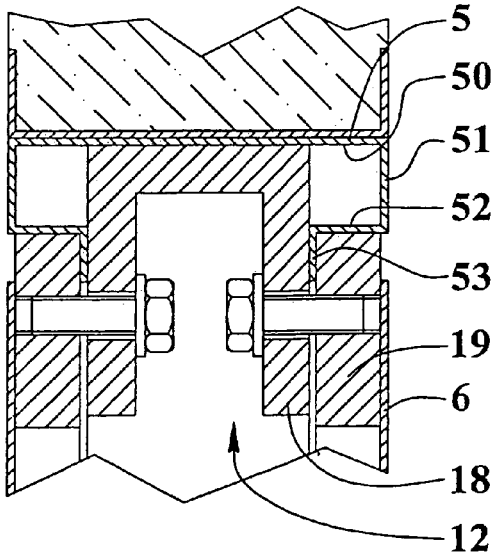
FIG.9

FIG.11
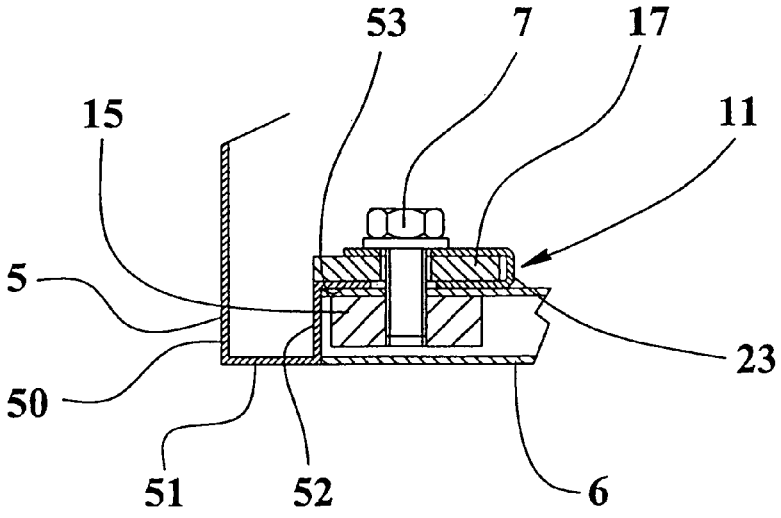
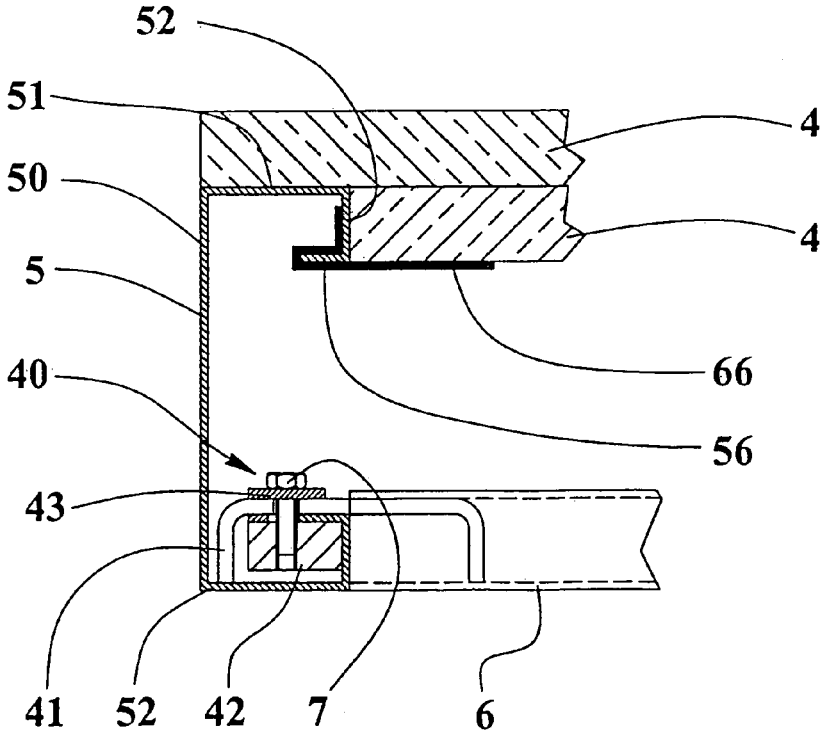
FIG.12

FIG.17
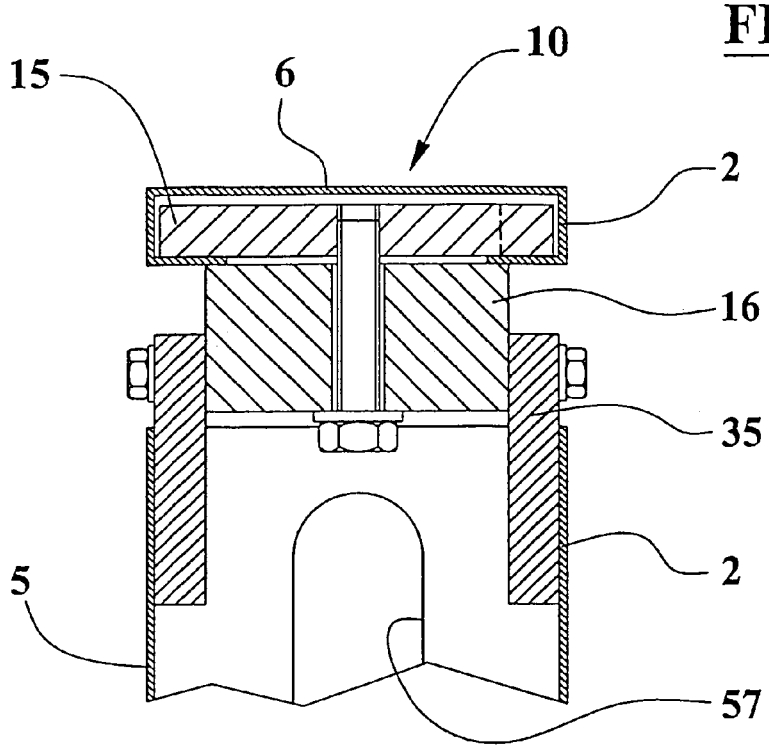
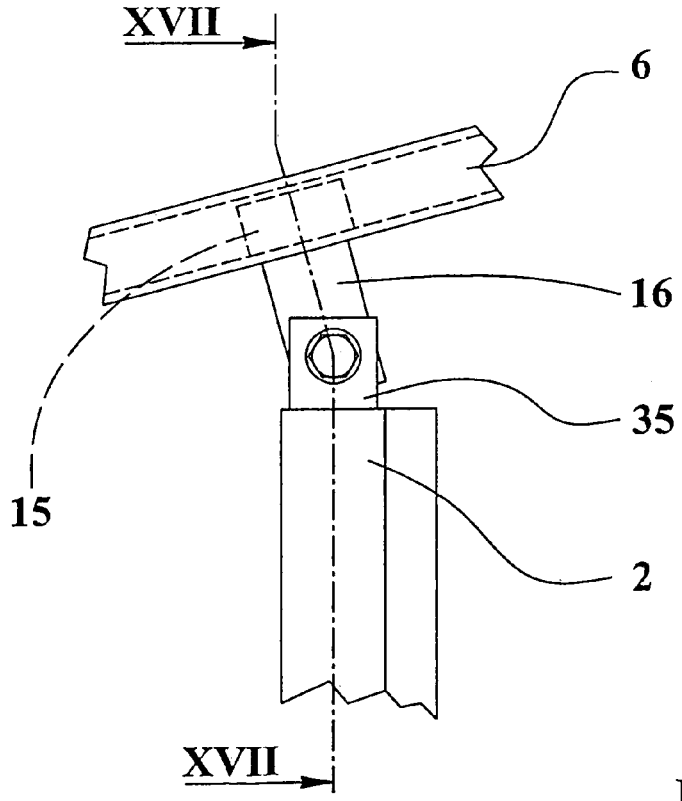
FIG.16

FIG.19
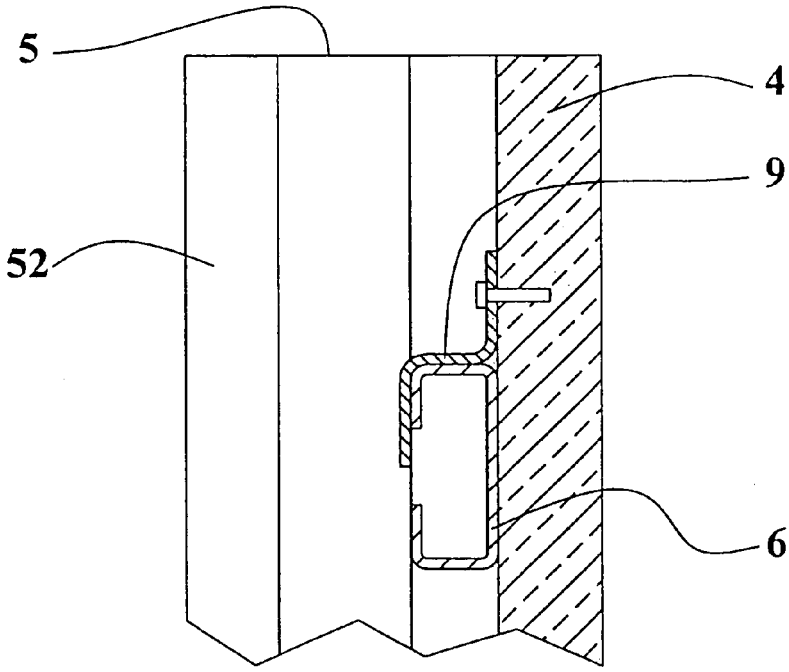
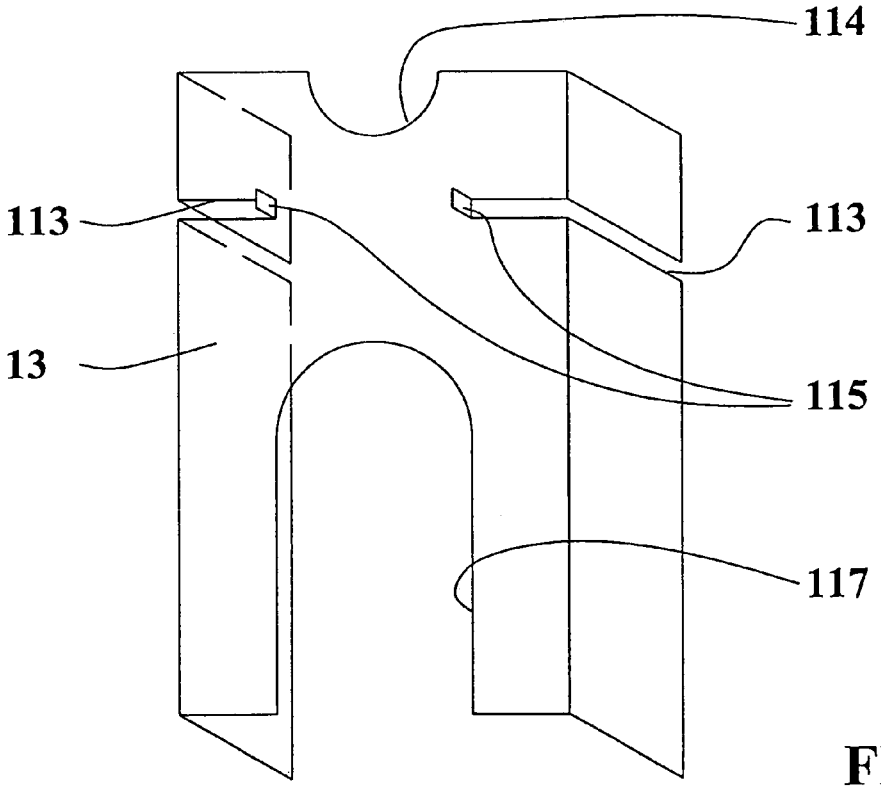
FIG.20

WALL DEVICE FOR FITTINGS

TECHNICAL FIELD

The present invention relates to devices used in the building manufacture and remodeling. Particularly, the invention refers to a wall device for housing fittings and supporting pipes, ducts, hot water sanitary systems, cables, wires, and other technology related connecting components.

BACKGROUND ART

There are known devices, generally used in building manufacturing and remodeling, constituted by structures or frameworks which are embedded and/or fixed to the walls in order to accommodate and support fittings, for instance pipes and sanitary equipment. These frameworks make it easier and quicker to install and assemble hot water sanitary equipment such as sinks, toilets, reservoirs, bidets or other goods for instance boilers, washers, or ducts for the air conditioning system or the passage of electric and signal cables.

Once the connection of the fittings is completed, the frameworks are then embedded or covered by fixed casing panels or by a second layer of wall.

The main drawback of said known devices is that they do not allow changes or modifications to the structure or the framework especially after the installation is completed.

Another drawback of the known devices consists in the elements having predefined and standard dimensions, which cannot be customized or modified, to accommodate the elements to be fixed and the characteristics of the place to be built and/or restructured.

A further drawback is that the known devices cannot be easily inspected and, in case of maintenance required of the inner fittings therein, they require substantial masonry work, first demolition and afterwards reconstruction.

Another drawback of the known devices is that they require a large amount of labor during the installation and assembly phase and a suitable prearrangement and preparation of the walls, inside which said device must be inserted, to allow for the appropriate embedding or seats to receive the devices.

DISCLOSURE OF THE INVENTION

The main object of the present invention is to propose a wall device for fixtures and fittings which is adjustable and customizable according to specific constructive requirements, and fit to be modified and also easily changed after the installation and the assembly.

Another object is to propose a device which can be fixed to an existing wall, requiring a minimum prearrangement of the preexisting walls, both in the construction phase and in the remodeling phase.

A further object is to propose a device that itself may constitute a self-supporting independent wall.

Another object is to provide a device having detachable covering panels, which allow easy and quick installation and inspection of the inner pipes and ducts and the hot water sanitary systems supported thereby.

The above-mentioned objects are achieved according to the content of the claims.

BRIEF DESCRIPTION OF THE DRAWINGS

The characteristics of the invention are underlined in the following description with particular reference to the attached drawings, in which:

FIG. 5 shows a partial section view according to line V-V of FIG. 1;

FIG. 6 shows a back view of connection means of the FIG. 1 device;

FIG. 7 shows a section partial view according to line VII-VII of FIG. 1;

FIG. 8 shows a front view of a variant of the FIG. 1 device;

FIG. 9 shows a partial section view according to line IX-IX of FIG. 8;

FIG. 9A shows a partial section view of a variant of third fixing means of FIG. 9;

FIG. 11 shows a partial section view of a variant of second fixing means of FIG. 5;

FIG. 12 shows a partial section view of a variant of a first channel section and of second fixing means of the FIG. 5 device;

FIGS. 16 and 17 show respectively a side view and partial section view according to line XVII-XVII of FIG. 16 of a variant of the first fixing means of the device of FIG. 1;

FIG. 19 shows a partial section view of removable hanging means for the device;

FIG. 20 shows an axonometric view of a further variant of the first fixing means of the FIG. 1 device;

BEST MODE OF CARRYING OUT THE INVENTION

Figure 1:
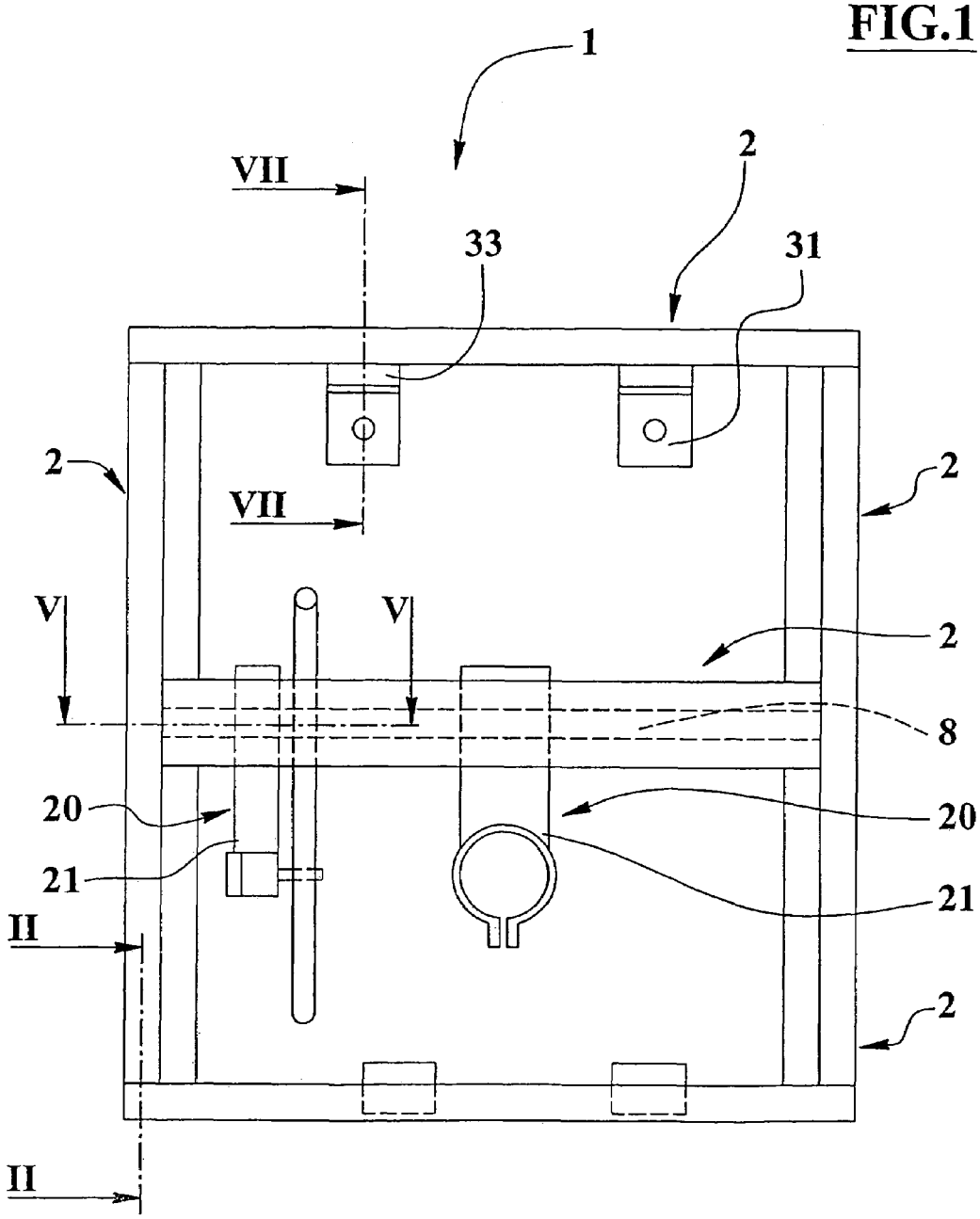
FIG. 1 shows a front view of the wall device for fittings and the like of the present invention.
Figure 2:
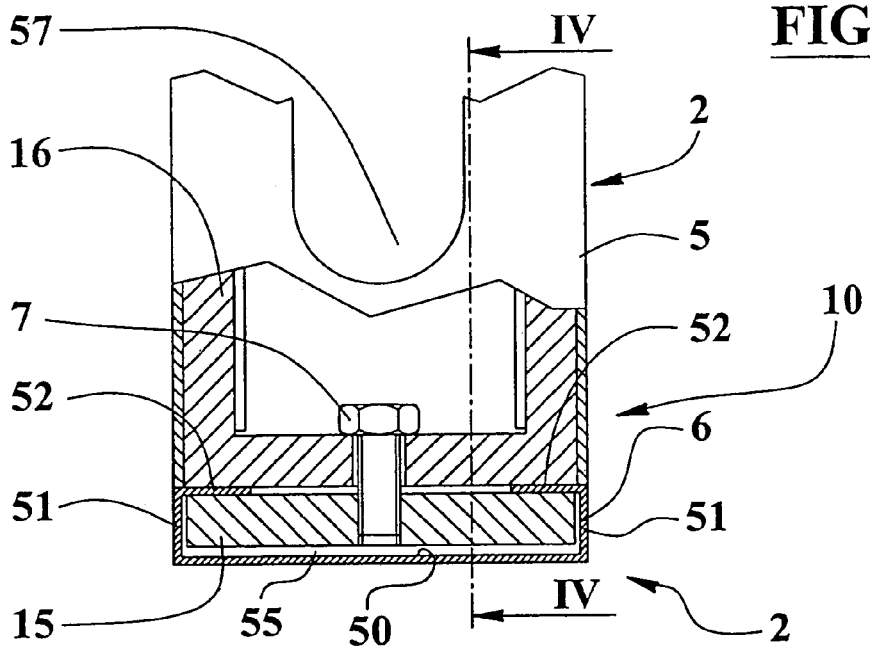
FIG. 2 shows a partial section view according to line II-II of FIG. 1.
Figure 3:
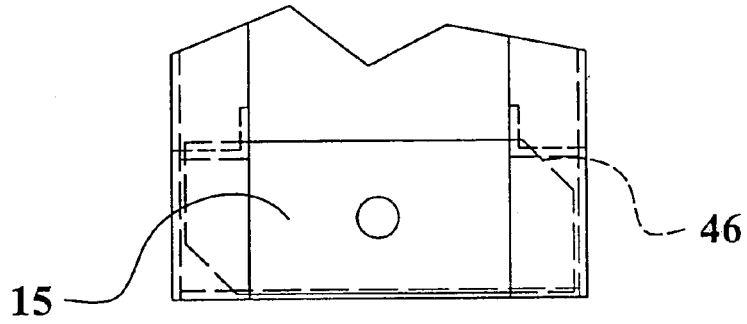
FIG. 3 shows a plant view of a plate mean of FIG. 2.
Figure 4:
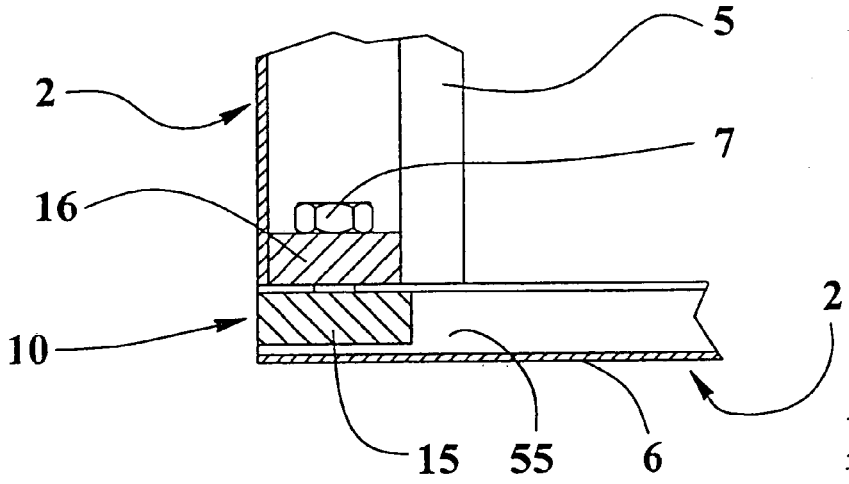
FIG. 4 shows a section view according to line IV-IV of FIG. 2.

With reference to FIGS. 1 to 7, numeral 1 indicates the wall device for fittings, for instance ducts, wirings, sinks, toilets, heaters, and other goods, which are known and not shown. The wall device 1 is substantially constituted by horizontal and vertical uprights 2, mutually connected through adjustable first fixing means 10. The device includes connection means 20 fit for connecting the fittings to the uprights 2.

Each vertical upright 2 is constituted by a first channel section 5 or by a second channel section 6, each including, starting from a respective bottom side 50, two respective opposed side parts 51, almost orthogonal to the bottom side 50, and two first portions 52 running parallel to the bottom side 50.

The bottom side 50, the side parts 51 and the first portions 52 define respectively a cavity 55 and a longitudinal opening 8 fit for housing the first fixing means 10 and the connection means 20.

With reference to FIG. 5, at least a first portion 52 of each first channel section has also a second portion 53 orthogonal to the first portion 52, facing outward from the respective cavity 55. The second portions 53 of the first channel section 5 are provided as an integral structure with the first channel section 5, by appropriately folding said first channel section.

In the preferred embodiment, the wall device 1 includes two vertical uprights 2, constituted by first channel sections 5, and two horizontal uprights 2, each one housing the second channel section 6.

The wall device 1 further has a middle horizontal upright 2 providing a second channel section 6 fit for supporting, through the connection means 20, the fittings, ducts, and other elements.

Each of the section channels 5, 6 have, in correspondence of the bottom side 50, one or more windows 57 which make it easier to introduce and pass through the device of pipes, ducts, wirings, etc., through the wall device.

The connection between a second channel section 6 and a first channel section 5 or a second channel section 6 of the uprights 2 is carried out by use of the first fixing means 10. Each of the first fixing means is composed of a plate mean 15, having a nearly rectangular shape, which can be insert inside the cavity 55 of the second channel section 6. The plate means 15 is removably connected to a first "V" shaped bracket mean 16, which can be fit inside the cavity 55 of the channel section 5, 6. The plate mean 15 and the bracket mean 16 clamp, by clamping means 7, for instance screws or bolts, the first portions 52 of the channel section 6, locking the second channel section 6 to the first fixing means 10. A sliding fixed joint is located between the fixing means 10 and channel section 5, provided by inserting the ends of the bracket mean 16 into the cavity 55 of the channel section 5.

The connection between a first channel section 5 and a second channel section 6 can be carried out by use of second fixing means 11. Each of the second fixing means is composed of the plate mean 15 and an abutment mean 17, removably connected, through clamping means 7, so as to clamp the second portion 53 of the first channel section 5 to the first portions 52 of a second channel section 6. In this case, by tightening the clamping means 7, the two channel sections 5, 6 are reciprocally locked together.

The second fixing means 11, as shown in FIG. 11, can include spacer means 23 which can be interposed between the clamping means 7 and the related abutment mean 17, to distribute more uniformly the clamping pressure on the portions of the channel section to be locked.

The plate mean 15 has two flat faces or chamfers 46, for instance which may be flat and parallel, carried out in correspondence to two opposed vertices of the same plate, to allow rotation when in the operational position, after the insertion in the cavity 55 through the longitudinal slot 8.

Third fixing means 12, shown in FIG. 9, are provided to allow connecting a first channel section 5 to another first channel section 5 or to a second channel section 6. The third fixing means 12 comprise a second bracket mean 18, "U" shaped and inserted inside the cavity 55 of the first channel section 5. The second bracket means 18 are removably connected, through the clamping means 7, to inserting means 19 which fit inside the cavity 55 of the remaining channel section 5, 6.

In an alternative embodiment, shown in FIG. 9A, the third fixing means 12 can be constituted by a plate mean 15, inserted inside the cavity 55 of the first channel section 5 and connected, through clamping means 7, to inserting means 19, which consist a channel section portion with a hollow rectangular section, inserted inside the cavity 55 of the remaining channel section 5, 6.

The end of the second bracket mean 18 and the inserting means 19 clamp the second portions 53 of the channel section 5, locking the channel section 5 to the first fixing means 10. The insertion of the inserting means 19 in the cavity 55 of the channel section 5, 6 provides a sliding fixing joint between the fixing means 10 and said channel section.

Figure 22:
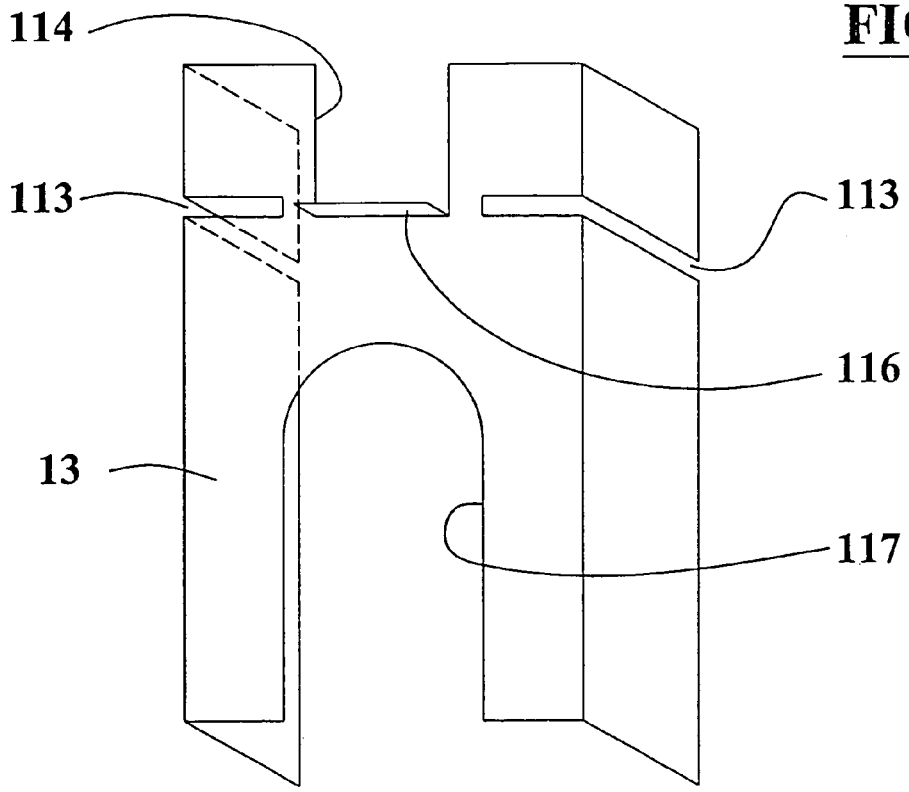
FIG. 22 shows a variant of the FIG. 20 fixing means.
Figure 21:
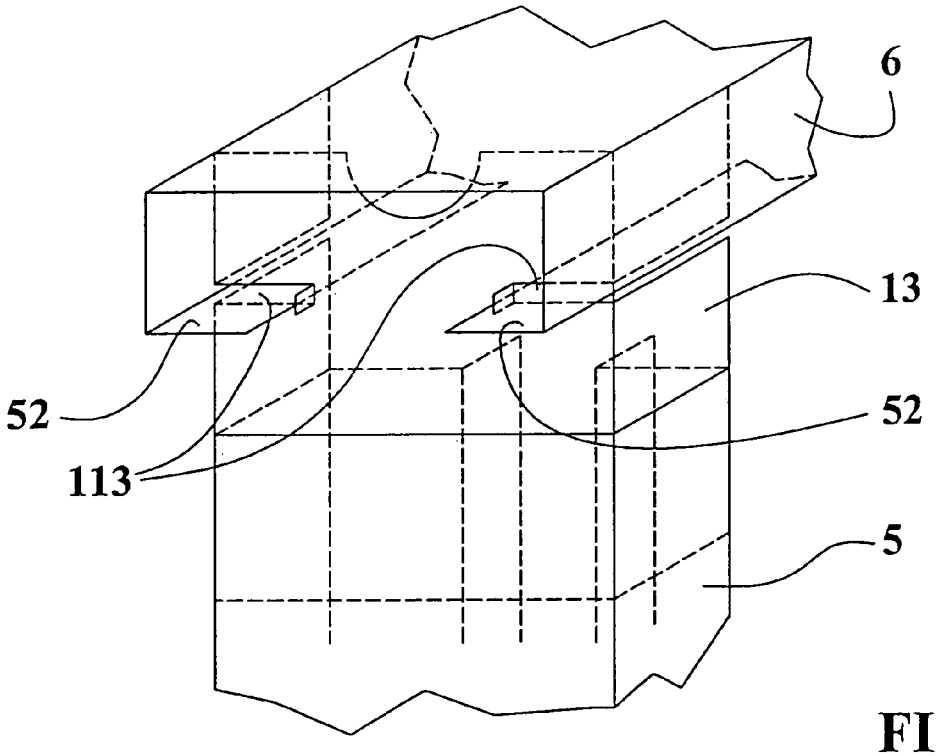
FIG. 21 shows a partial axonometric view of the variant of FIG. 20 connected to channel sections.

Referring to FIGS. 20 to 22, the device 1 includes sixth fixing means 13, consisting of a "C" shaped element, which can be inserted inside the first channel section 5 and is provided with at least a pair of lateral slots 113, allowing the insertion, by rotations, of the first portions 52 of a second channel section 6.

The end of central wall of sixth fixing means 13, close to the lateral slots 113, has a first recess 114 for avoiding interferences with the nuts or screw heads used for fixing the second channel section 6 to a ceiling or to a floor.

An inner end of the first recess 114 has a tab 116 protruding outwards to form a stop for the first channel section 5. Alternatively, the inner ends of the lateral slots 113 can be provided with corresponding tabs 115, protruding outwards to form a stop.

An end of a central wall of the sixth fixing means 13, opposed to the lateral slots 113, has a second recess 117, used to make easier the assembly operation.

Figure 23:
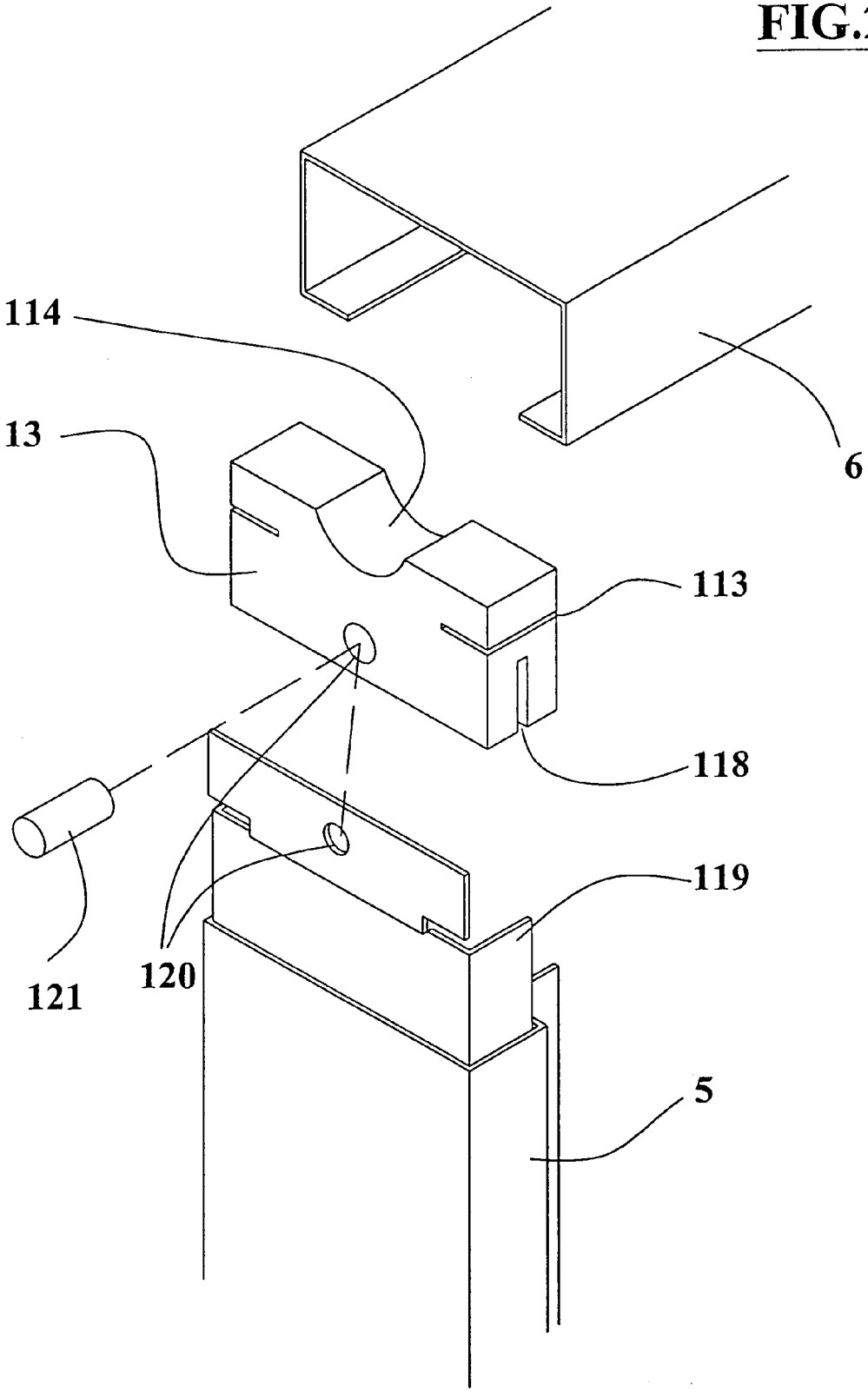
FIG. 23 shows a further variant of the FIG. 20 fixing means.

The sixth fixing means 13 shown in FIG. 23, have a parallelepiped shaped element made of solid plastic, having one free end provided with a housing mean 118 consisting of a slot for receiving a protrusion of a related coupling mean 119 which can be inserted inside the first channel section 5. Housing mean 118 and coupling mean 119 are provided with respective holes 120 for receiving a fixing pin 121 or screw.

Figure 24:
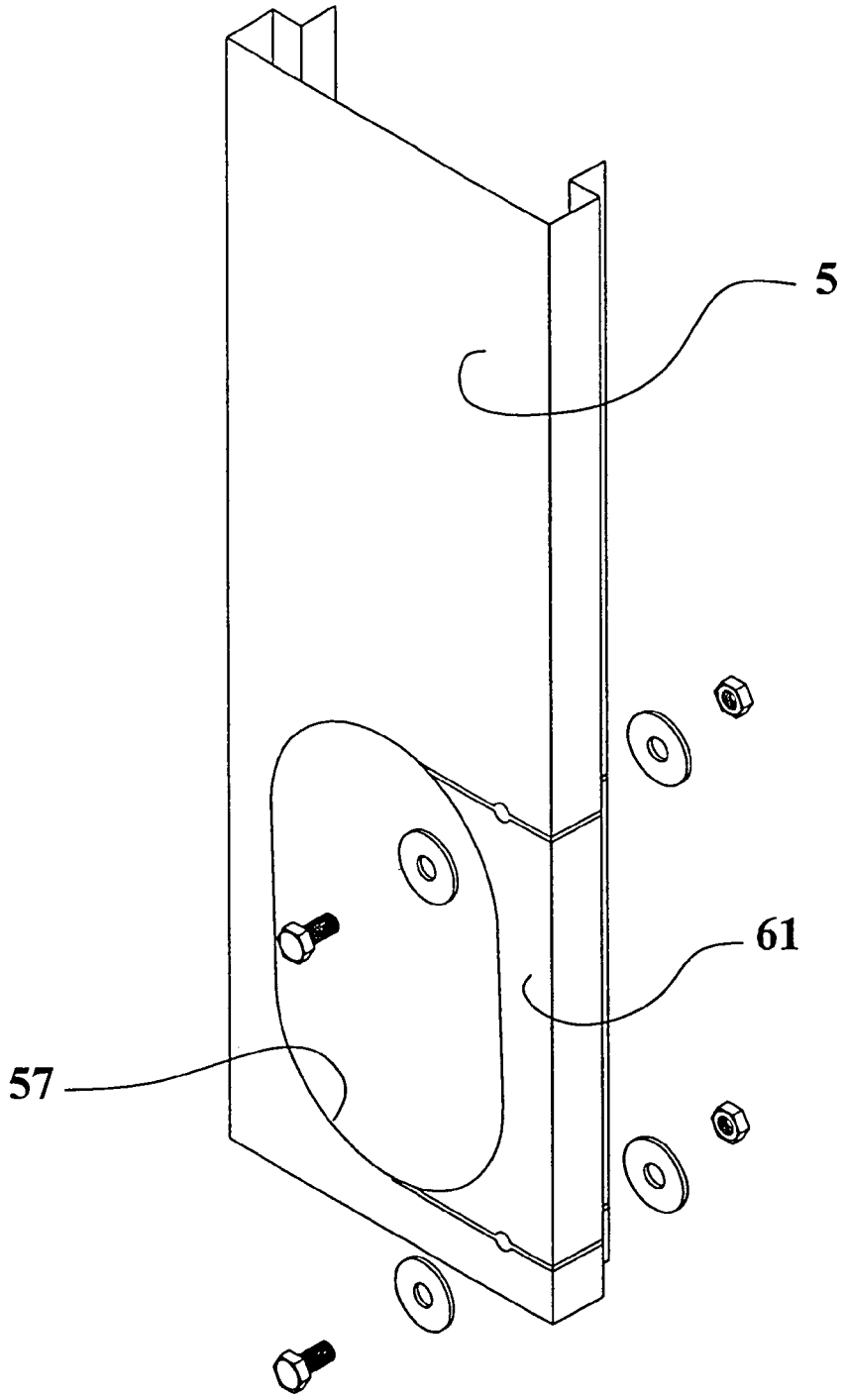
FIG. 24 shows a variant of the channel section of FIG. 2.

The channel section 5 shown in FIG. 24 has a removable portion 61, positioned over the window 57 provided for inserting elements such as pipes or tubes. The removable portion 61 is fixed to the channel section 5, 6 by means of screws, nuts and washers.

The wall device 1 can be embedded into a suitable opening or cavity in a wall 60, or can be simply leaned against the wall 60.

The device is fixed to the wall 60 by a plurality of fastening means 30, comprised of a plate mean 15, inserted in the cavity 55 of an second channel section 6 and removably connected to a "L" shaped bracket mean 31, through clamping means 7. (See FIG. 7) The bracket mean 31 is fixed to the wall 60 by means of screws or bolts, of known type, and it has a slot 32 for allowing the regulation of the clamping means 7 position and, consequently, the distance of the device 1 from the wall 60. Such a feature is particularly advantageous in the case where the wall have noticeable shape irregularities.

With reference to FIG. 5, each connection mean 20 includes a support 21, which is detachably connected through clamping means 7, to a plate mean 15 inserted in the cavity 55 of a second channel section 6 of a middle horizontal upright 2. In order to avoid rotation of the support 21 with respect to the upright 2, an anti-rotation bracket 22 is provided which is U shaped and connected to the support 21, whose ends are inserted in the longitudinal slot 8 of the related channel section 6, for avoiding rotation of the connection mean 20.

Figure 13:
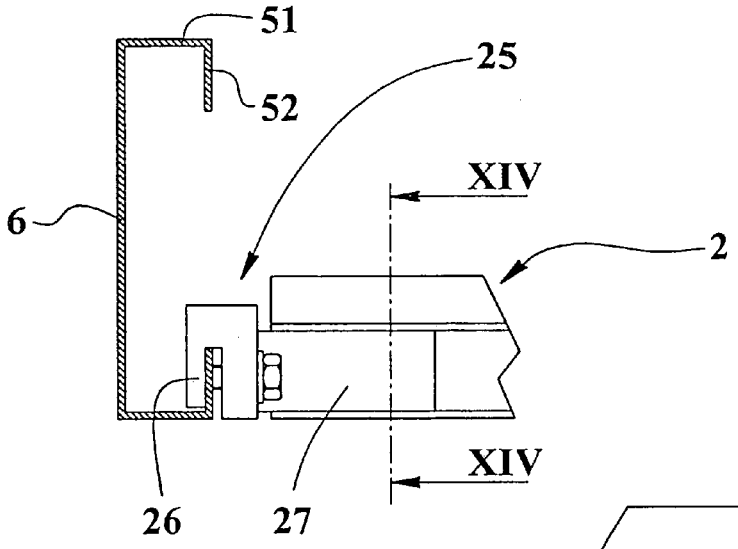
FIG. 13 shows a view of fourth fixing means of the FIG. 1 device associated to second channel sections in which some parts have been removed for better underlining others.
Figure 14:
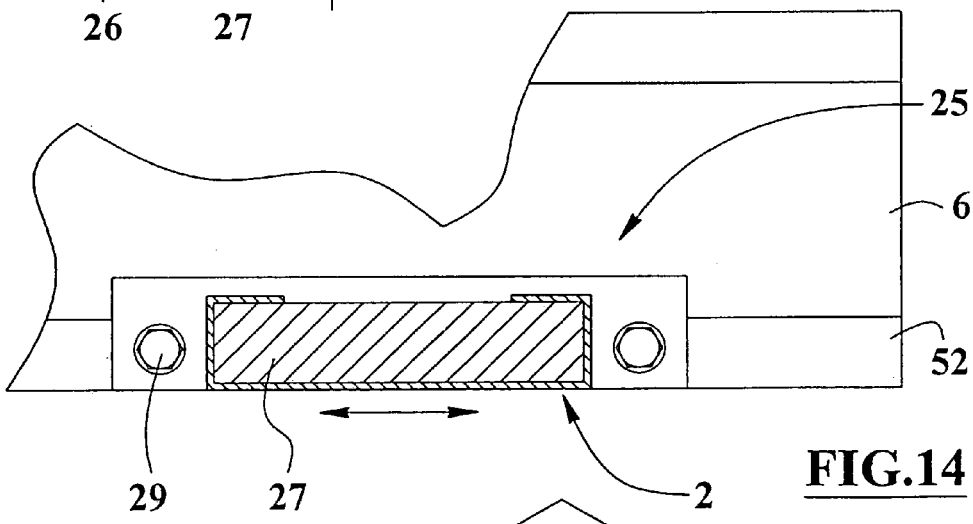
FIG. 14 shows a partial section view according to line XIV-XIV of FIG. 13.
Figure 15:
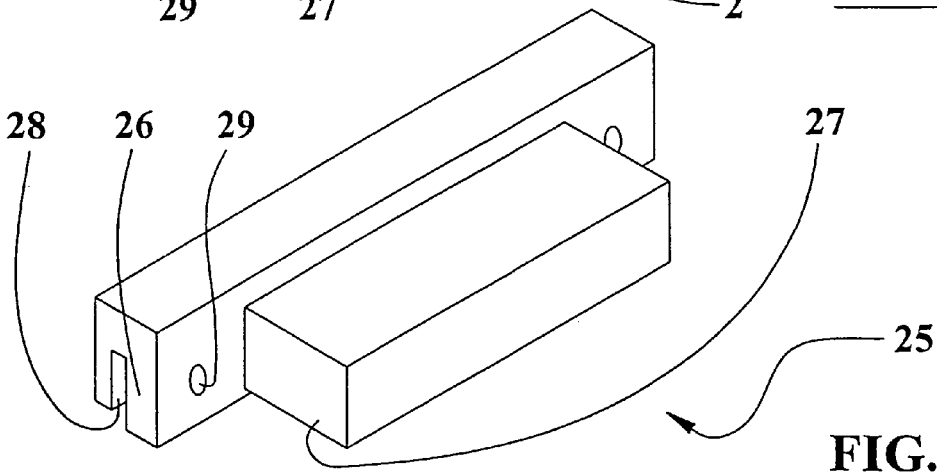
FIG. 15 shows an axonometric view of the fourth fixing means of FIG. 13.

The device further includes fourth fixing means 25, shown in FIGS. 13-15, which adjustably connect the second channel sections 6 to the first channel section 5 or to the second channel section 6. Each fourth fixing mean 25 includes a first portion 26 having a transversal seat 28 which accommodates a first portion 52 of a channel section 6 and a protrusion 27, which is almost orthogonal to the transversal seat 28 and which can be inserted inside the cavity 55 of a corresponding channel section 5, 6. Threaded means lock the fourth fixing mean 25 to the portion 52 of the channel section 6, once the related positions of the two channel section are set.

Covering panels 4, for instance made of Fermacell or vibrated cement or asbestos gypsum, are fixed to the uprights 2, and particularly positioned against the portions 52, 53 of the first channel sections 5 and second 6 channel sections by threaded connections of known type.

Sealing means can be interposed between the first channel sections 5 and second 6 channel sections and the panels 4.

Figure 10:
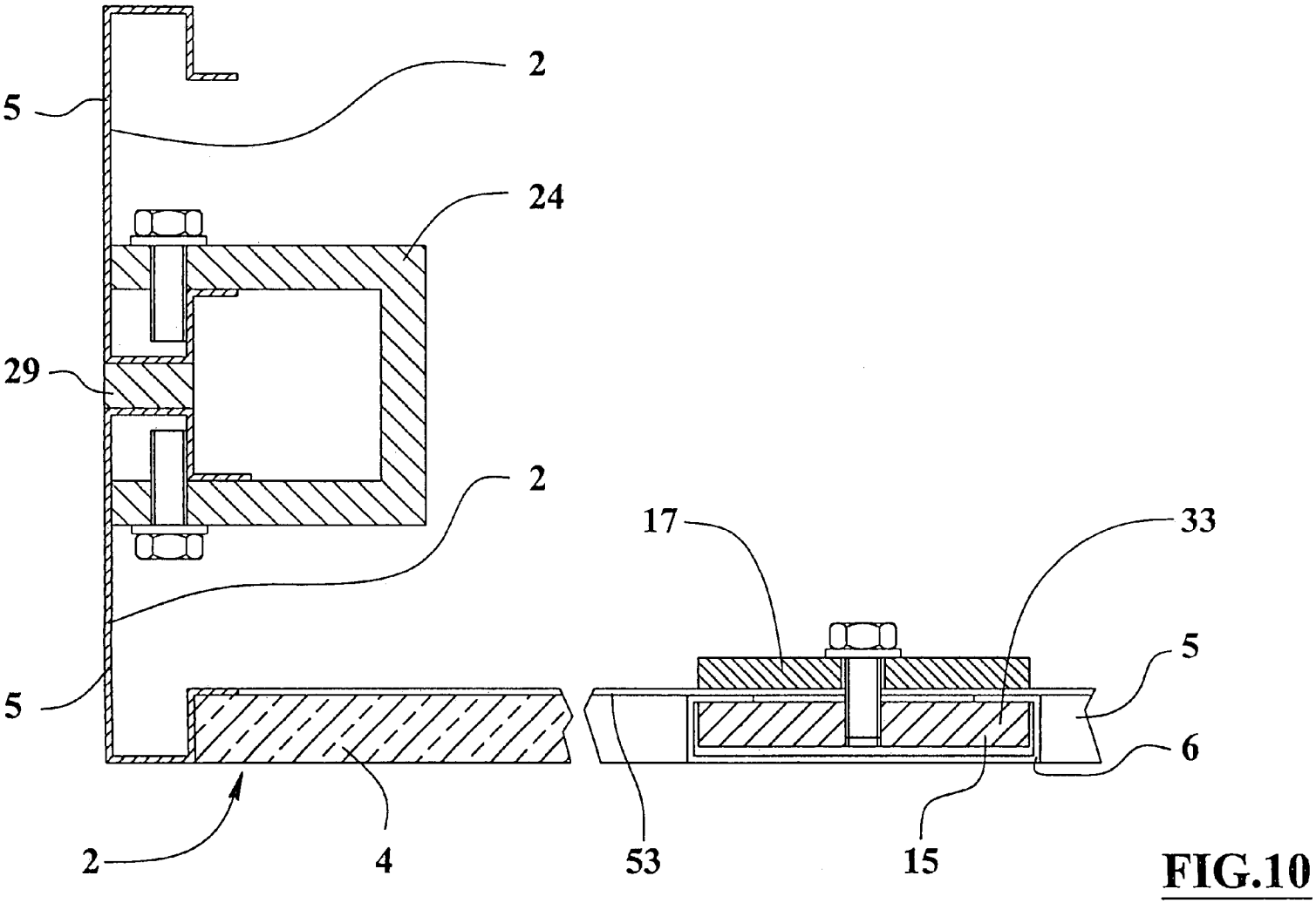
FIG. 10 shows a partial section view according to line X-X of FIG. 8.

FIGS. 8 to 10 show a variant of the wall device 1, comprising two horizontal uprights, upper and middle, constituted by first channel sections 5, and by a vertical middle upright consisting of a second channel section 6. The vertical uprights are carried out by two first channel sections 5, which are sideways coupled with the interposition of an abutment spacer 29 and connected to connection means 24, consisting for instance of a U shaped bracket, containing the edges 52, 53, locked in position by clamping means, which sideways contact said first portions 52.

The connection between the channel section 6 of the middle vertical upright and the channel sections 5 of the two horizontal uprights is carried out by clamping the portions 52, 53 between an abutment plate 33 inserted inside the cavity 55 of the channel section 6 and the abutment mean 17.

In this case the wall device 1 is inserted into a passage or blind space carried out in the wall 60, to which it is sideways clamped by lock means 59, of known type, screwed or welded or glued to channel sections 5, 6 of the device 1.

L shaped bracket 34 of known type, is used to mutually irremovably connect the vertical and horizontal uprights 2 in such a way as to provide a rigid, and fixed wall device structure.

Another variant of the device 1, shown in FIG. 12, uses a first channel section 5 in which the second portion 53 consists in a shaped channel section 66, fixed to an inner protrusion 56 of a corresponding first portion 52.

A variant of the first fixing means 10, shown in the FIGS. 16 and 17, provides first bracket mean 16 constituted by two separate portions, reciprocally rotatably coupled together and connected respectively to the plate mean 15 and to a channel section 5, 6. The two portions can reciprocally rotate around an axis nearly orthogonal to the plane defined by the device 1, to allow for adjusting the inclination of an horizontal upright 2 with respect to the vertical uprights, for instance when the device 1 must be inserted in an room having a sloping ceiling, such as an attic, a garret, a closet.

Fifth fixing means 40 connect the first channel section 5 to another first channel section 5 or to a second channel section 6. The fifth fixing means 40 are substantially constituted by a nearly U shaped connection element 41. A portion is inserted inside the cavity of a channel section 5, 6, while the remaining portion mates the bottom side 50 of the channel section 5. In particular, the element 41 is locked to the inner protrusion 56 of the portion 52 of the channel section 5 by means of an insert 42, disposed adjacent to the portion 52, to which said insert 42 is removably connected by a screw. A spacer element 43 is interposed between the screw head and the connection element 41 and between the connection element and the insert 42, guarantying a more stable clamping of the fixing means 40.

Figure 18:
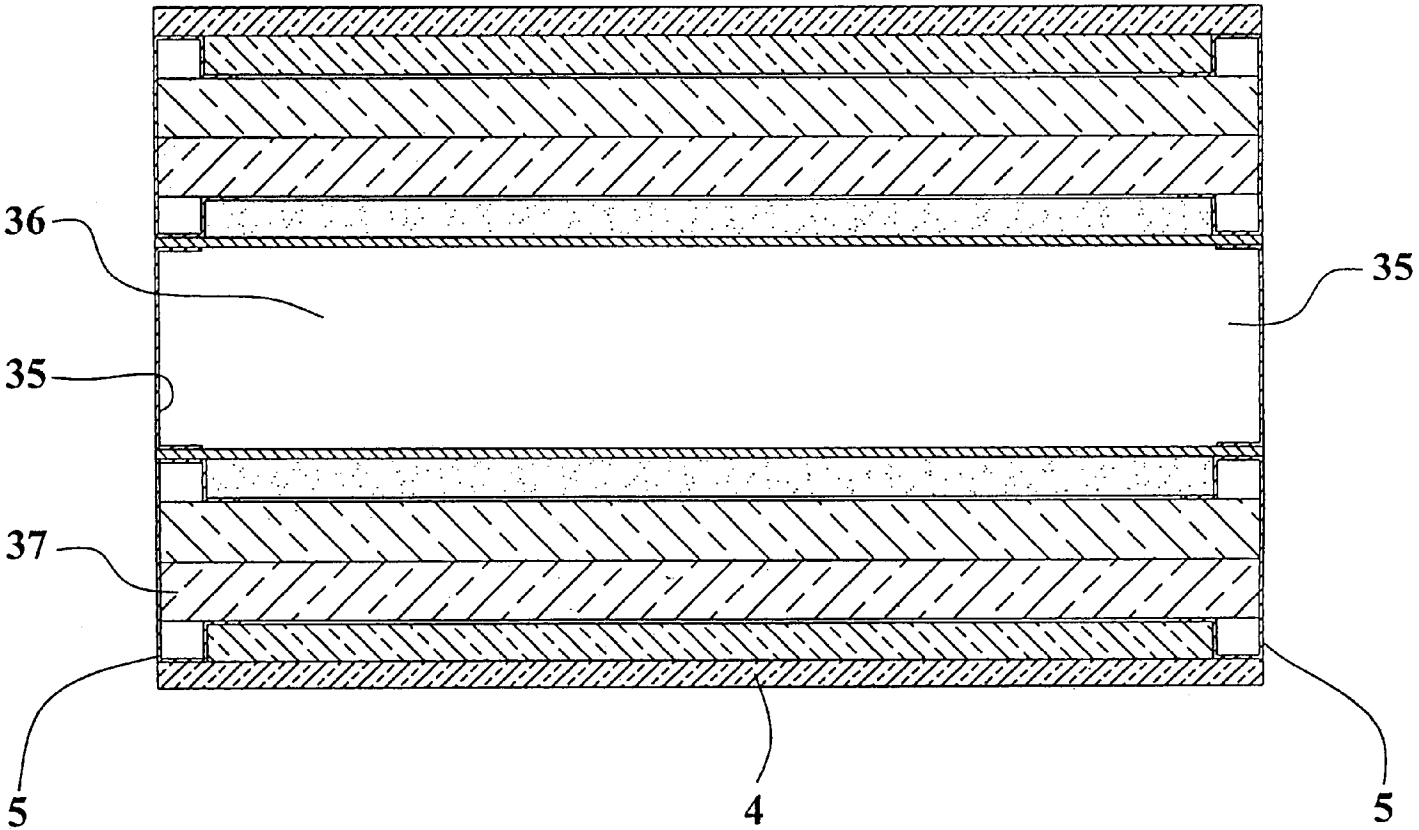
FIG. 18 shows a partial cross section view of a further variant of the device of FIG. 1.

FIG. 18 shows a further variant of the wall device 1 including spacing means 35 for the uprights 2, positioned side by side. The spacing means 35 form a space 36 delimited by said horizontal and vertical uprights 2. The space 36 is used for housing fittings, wirings, pipes or provides an interspace for ventilation, usable for the summer and winter air conditioning of the room in which the device is inserted.

The covering panels 4 are screwed to the uprights 2 or, with reference to FIG. 19, the covering panels 4 are removably fixed to horizontal uprights 2 by means of a plurality of hanging means 9. Each hanging means includes an "S" shaped section element, fixed to the covering panel 4 by means of screws to form a side for the horizontal uprights 2, consisting of a second channel section 6.

In this embodiment, insulation panels 37 have ends inserted and fixed, for instance by adhesive or by screws, in the longitudinal openings 8 of the channel section 5, 6 which constitute the uprights 2. Covering panels 4 are provided on the external sides of the device 1, while further insulation panels, for instance made of polystyrene, or separation panels 38, made of cement material or the like, can be inserted inside the interspace 35.

The main advantage of the present invention is to provide a wall device for fixtures and fittings, which is adjustable and customizable according to specific constructive requirements, and which may be modified and also easily changed after the installation and assembly is complete.

Another advantage is to provide a device, which can be fixed to an existing wall, requiring a minimum of revisions to the preexisting walls, both in the construction phase and when remodeling.

A further advantage is to provide a device fit to constitute a self-supporting independent wall.

Another advantage is to provide a device having detachable covering panels, in order to allow for easy and quick installation and inspection of the inner pipes and ducts and the hot water sanitary devices supported thereby.

The invention claimed is:

1. A wall device for receiving fittings therein comprising:

a plurality of horizontal and vertical uprights (2) mutually coupled by at least first fixing means (10);

connection means (20) for joining the fittings;

the uprights (2) including at least a first channel section (5) and a second channel section (6), each channel section including, starting from a respective bottom side (50), two respective opposed side parts (51) nearly orthogonal to the bottom side (50), and two respective first portions (52) parallel to the bottom side (50), said sides, parts and portions (50, 51, 52) of at least the first channel section (5) and the second channel section (6) defining respective cavities (55) and longitudinal openings (8), at least a first portion (52) of each first channel section having a second portion (53) orthogonal to the first portions (52) and facing outwards from the respective cavity (55), at least one second portion (53) being a shaped channel section (66) fixed to an inner protrusion (56) of a corresponding first portion (52), said wall device including two vertical uprights (2), each vertical upright having a second channel section (6);

first fixing means (10) being adjustable and the longitudinal openings (8) receiving the first fixing means (10) and the connection means (20), the first fixing means connecting a second channel section (6) to an upright (2), the first fixing means comprising plate means (15) insertable inside the cavity (55) of the second channel section (6) and being removably connected, through clamping means (7), to a first bracket means (16), which can fit inside the cavity (55) of the upright (2);

second fixing means (11) consisting of a plate means (15) and an abutment means (17), removably connected by clamping means (7) for clamping the second portions (53) of a first channel section (5) and the first portions (52) of a second channel section (6).

2. The wall device according to claim 1 wherein the second portions (53) of the first channel section (5) are integral with the first channel section.

3. The wall device according to claim 1 wherein at least one second portion (53) consists of a shaped channel section (66) fixed to an inner protrusion (56) of a corresponding first portion (52).

4. The wall device according to the claim 1 wherein each first channel section and each second channel section has, in correspondence to the bottom side (50) at least one window (57).

5. The wall device according to claim 4 wherein each channel section (5,6) has a removable portion (61) to cover the window.

6. The wall device according to the claim 1 wherein the plate mean (15) has a nearly rectangular shape with at least two flat faces (46), carried out in correspondence of two opposite vertices of the plate means.

7. The wall device according to claim 1 further comprising third fixing means (12) for connecting two channel sections, the third fixing means composed of a second U shaped bracket mean (18), insertable inside the cavity (55) of one of the two channel sections (5) and being removably connected through clamping means (7) to inserting means (19), which are insertable into an inside of the cavity (55) of the second of the two channel sections.

8. The wall device according to claim 1 wherein the clamping means (7) include screws or bolts.

9. The wall device according to claim 1 wherein the second fixing means (11) include spacer means (23) interposed at least between the abutment means (17) and the second channel section (6).

10. The wall device according to claim 1 wherein the first bracket means (16) includes two portions rotatably coupled together and connected respectively to a plate means (15) and to a channel section (5, 6).

11. The wall device according to claim 1 further comprising sixth fixing means (13), consisting of a shaped element which can be inserted into the first channel section (5) and is provided with at least a couple of lateral slots (113) for inserting, by rotation, the first portions (52) of a second channel section (6), an end, close to the lateral slots 20 (113), of a central wall of sixth fixing means (13) has a first recess (114), inner ends of the lateral slots (113) having corresponding tabs (115) protruding outwards to form a stop for the first channel section.

12. The wall device according to claim 11 wherein the inner end of the first recess (114) has a corresponding tab (116) protruding outwards to form a stop for the first channel section (5).

13. The wall device according to claim 11 wherein the end of the central wall of the sixth fixing means (13) opposed to the lateral slots (113) has a second recess (117).

14. The wall device according to claim 11 wherein the sixth fixing means (13) consists of a parallelepiped shaped element or a "C" shaped element.

15. The wall device according to claim 14 wherein one free end of the parallelepiped shaped element has housing means (118) for housing related coupling means (119) which are insertable inside the channel section (5,6).

16. The wall device according to claim 15 wherein the housing means (118) and coupling means (119) are provided with respective holes (120) for receiving a fixing pin (121).

17. The wall device according to claim 1 further comprising a plurality of fastening means (30) for fixing the wall device (1) to a wall (60).

18. The wall device according to claim 17 wherein each fastening mean (30) includes a plate means (15), inserted into the cavity (55) of the second channel section (6) and removably connected to an L shaped bracket mean (31), by clamping means (7).

19. The wall device according to claim 18 wherein the L shaped bracket means (31) includes at least a slot (32) for the clamping means (7).

20. The wall device according to claim 1 further comprising a plurality of locking means (59) for locking the wall device (1) to a space provided in a wall (60).

21. The wall device according to claim 1 wherein the connection means (24) connect two first channel sections positioned side by side.

22. The wall device according to claim 21 wherein the connection means (24) include an U shaped element and screw means of side abutment of the first portions (52) of the first channel section (5).

23. The wall device according to claim 22 wherein the connection means (24) further include an abutment spacer (29) of the side parts (51) of the first channel sections (5) for reciprocally spacing apart said side parts.

24. The wall device according to claim 1 wherein each connection means (20) includes at least a support (21) for a fitting element, the support removably connected to a plate means (15), inserted in the cavity (55) of a second channel section (6), through clamping means (7).

25. The wall device according to claim 24 wherein the connection means (20) include an anti-rotation bracket (22), connected to the support (21) and partially inserted into the longitudinal opening (8) of the second channel section (6).

26. The wall device according to claim 1 further comprising fourth fixing means (25) each having a first portion (26), having at least a transversal seat (28) for housing a part of a first portion (52) of a second channel section (6), and a protrusion (27), almost orthoganal to said transversal seat (28), which is insertable into the cavity (55) of a respective channel section (5, 6).

27. The wall device according to claim 26 wherein the fourth fixing means (25) include threaded means for locking the portion (52).

28. The wall device according to claim 1 further comprising fifth fixing means (40) for connecting two channel section (5, 6), the fifth fixing means including a U shaped connection element (41), a first portion of which is removably connected by clamping means (7), to an insert (42), for locking the inner protrusion (56) of one of the two first channel sections (5), and a second portion insertable into the cavity (55) of a second of the two channel sections (5,6).

29. The wall device according to claim 28 wherein the fifth fixing means (40) include a shaped spacer element (43) interposed between the clamping means (7) and the connection element (41), and between the connection element and the insert (42).

30. The wall device according to claim 1 further comprising third fixing means (12) for connecting two channel section (5, 6) and consisting of a plate means (15), inserted inside the cavity (55) of one of the two channel sections and connected by clamping means (7) to inserting means (19), fit inside the cavity (55) of a second of the two channel sections (5,6).

31. The wall device according to claim 30 wherein the inserting means (19) consist of a channel section portion with rectangular cross section.

32. The device according to claim 1 further comprising at least one covering panel (4) fixed to the uprights (2).

33. The wall device according to claim 32 wherein the covering panels (4) are screwed to the vertical uprights (2).

34. The wall device according to claim 32 wherein the covering panels (4) are removably fixed to horizontal uprights (2) by means of a plurality of hanging means (9).

35. The wall device according to claim 34 wherein each hanging means (9) includes an "8" shaped section element fixed to the covering panel (4) by means of screws in order to form a side for the horizontal uprights (2).

36. The wall device according to according to claim 34 further comprising sealing means interposed between the uprights (2) and the panels (4).

37. The wall device according to claim 1 further comprising at least one insulation panel (37) whose peripheral portions are inserted inside the longitudinal openings (8) of the channel sections (5, 6).

38. The wall device according to claim 1 further comprising spacing means (35) for uprights (2) positioned side by side, for forming a space {36) delimited by said uprights (2).

* * * * *